United States Patent [19]

Butler et al.

[11] 4,352,386

[45] Oct. 5, 1982

[54] AUTOMATIC CORD LOCK DEVICE

[75] Inventors: John Butler, Long Beach; L. George Valle, Huntington Beach; Donald E. Wall, Mission Viejo, all of Calif.

[73] Assignee: Liken Home Furnishings, Westminster, Calif.

[21] Appl. No.: 108,343

[22] Filed: Dec. 31, 1979

[51] Int. Cl.[3] ..... E06B 9/38; E06B 9/324

[52] U.S. Cl. ..... 160/178 C; 24/136 A

[58] Field of Search ..... 24/136 A, 115 L, 115 M; 160/168, 178 C, 177

[56] References Cited

U.S. PATENT DOCUMENTS

| | | | |
|---|---|---|---|
| 1,951,528 | 3/1934 | Pearson | 160/178 C |
| 2,165,492 | 7/1939 | Lorentzen | 160/177 |
| 2,318,213 | 5/1943 | Fox | 24/136 A |
| 2,494,759 | 1/1950 | Hirschy | 24/136 A |
| 3,952,789 | 4/1976 | Marotto | 160/178 C |
| 4,180,118 | 12/1979 | Vecchiarelli | 160/178 C |

*Primary Examiner*—John E. Murtagh
*Assistant Examiner*—Cherney S. Lieberman

[57] ABSTRACT

A cord locking device includes a channel-shaped housing within which a roller is rotably mounted. Oppositely positioned slots within the housing carry a serrated second roller down and away from said first roller, said serrated second roller travels along a grooved wall section, which has a bent portion at the lowermost portion thereof, permitting the second roller to rotate free of the wall at that position. A cord is trained over the first roller and is locked thereto or freely movably depending upon the position of the second roller.

1 Claim, 13 Drawing Figures

AUTOMATIC CORD LOCK DEVICE

BACKGROUND OF THE INVENTION

This invention relates to cord holding devices and particularly those whose function is to operate with venetian blinds or wooden shades. The term automatic is utilized to denote the designed reluctance of this device to permit unabated downward movement of the shade structure.

Various attempts have been made to provide a cord locking device of the above-mentioned type. Those prior assemblies illustrate complex structures incorporating variously positioned pulleys or wedges which restrict the movement of the pull cord. The number of moving parts as well as the difficulty of use often resulted in failure after a short period of time, in addition, cord wear was readily apparent in the previous attempts because of the continued engagement between the pull cord and gear teeth on pawls within the locking device. Prior devices also failed to solve the problems of shade crashing which was likely to occur when an individual operating the cord locking device let go of the cord.

SUMMARY OF THE INVENTION

According to the present invention there is provided a cord lock device which is completely automatic in operation, has a minimum number of movable parts, thus reducing the potential for failure, and solves the problem of shade crashing.

In the cord lock device disclosed herein a channel-shaped housing has a first roller mounted therein about which is trained a pull cord of conventional type. The pull cord has a substantially vertical portion which is adapted to be drawn downwardly by an individual operating the cord locking device. In this manner, the slat portion of the shade is pulled upwardly thus compressing the shade located superior thereto. Disposed within the vertical walls of the channel-shaped housing are oppositely positioned and substantially parallel slots extending at an angle downward and outward from the first roller. A second cylindrical roller or pawl has a pin axially extending from the ends thereof, the pin being of a smaller diameter than the width of the angled slots in which they vertically traverse. The second roller has serrations circumferentially extending threfrom, these serrations being engageable with a serrated ramp extending between the wall sections of the channel-shaped housing.

At the lowermost portion of the ramp, a lip is bent away from the plane of the ramp, the lip also having serrations thereon. The lip is positioned with respect to the slot such that when the second cylindrical roller is at its lowermost position within the angled slots it floats freely and does not engage the serrated ramp. The serrated second roller has a diameter larger than the width of the slot, thereby minimizing the possibility that the pull cord will become lodged within the slot during use.

When the pawl is at the lowermost portion of the slot, minimum cord wear is achieved because of the absence of friction acting upon the cord. When the shade portion is in a compressed position, an upward force acts upon the cord when in an unlocked position. As the cord is let loose by the individual operating the device, the pawl will move upward with the cord until it engages the serrated wall at which point it will ride along the wall thus clamping the cord between it and the first roller.

In a second embodiment of the invention an angular channel-shaped bracket has a first and second roller mounted therein with the second roller being carried down and away from the first roller by oppositely positioned substantially parallel slots. A serrated or smooth slug is attached to the sidewalls of the bracket, the slug engaging the serrations present on the second roller when serrations are used. At the lowermost portion of the slots, the second roller is carried to a position wherein the cord or cords suspended between the first and second rollers are permitted to operate freely over the first roller. When the cord or cords are subsequently permitted to extend vertically, a second roller is engaged and caused to move upward with the cords until the distance between the first and second roller is such that the cord is held in a stationary manner therebetween. In this manner, the slats and blind structures of the shade device are prevented from moving downward in an unabated fashion.

It is therefore a principal object of the present invention to provide a cord lock which minimizes the possibility of shade crash.

It is another object of the present invention to provide a cord lock device adapted to operate with various numbers of cords.

It is yet another object of the present invention to provide a cord lock device with a minimum number of moving parts.

It is yet another object of the present invention to provide a cord lock device which requires minimum lifting force to accomplish shade movement.

It is yet another object of the present invention to provide a cord lock device which reduces cord clogging.

It is another object of the present invention to provide a cord lock device which illustrates minimum cord wear.

Other objects of my invention in part will be obvious and in part will be disclosed hereinafter within the detailed description and the accompanying drawings.

DESCRIPTION OF THE PREFERRED EMBODIMENT

Figure 1:
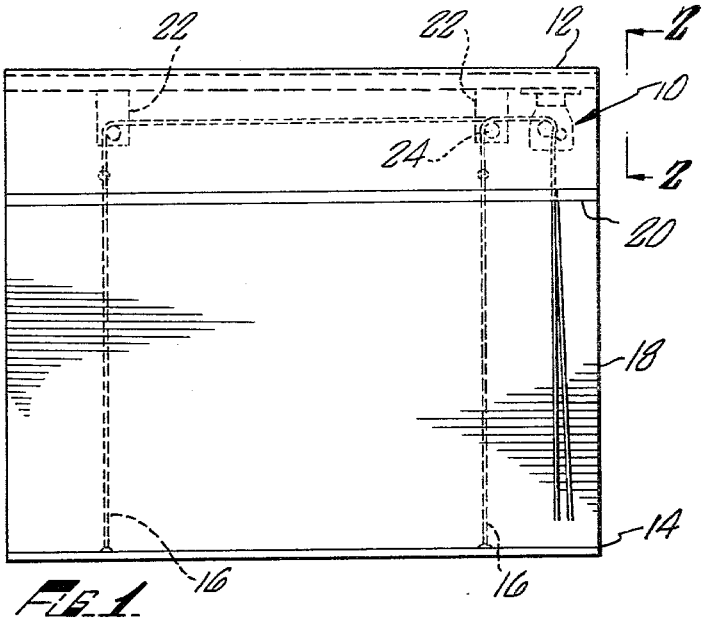
FIG. 1 is a front view of the cord lock device of the present invention in an operative position.

Referring now in detail to the drawings, and in particular FIG. 1, the cord lock device 10 of the present invention is shown mounted in an operative position. A laterally extending head bracket 12 is secured to the ceiling or wall from which the shade structure will hang, the bracket 12 having a suspended slat assembly 14 affixed to multiple cords 16 by conventional means, which may consist of hooks or mechanical halting assemblies. The position of the slat 14 determines the extension of the blind 18 and is variable in accordance with the length of the vertically extending cords 16.

At the uppermost portion of the shade 18 an overlapping section 20 hides and protects the cord lock device 10 and other associated components found therein. Under the section 20 and rigidly attached to the head bracket 12 are multiple pulley mounts 22 having rotable pulleys 24 secured thereto about which the vertically extending pull cords 16 are trained. The number and relationship of the pulley mounts 22 and associated assemblies is variable in accordance with the weight and aesthetics of the blind 18 to be suspended and acted upon. It should be readily apparent that other devices may also be used to guide and suspend the cords 16 and thus work in connection with the cord lock device 10. Although only two cords 16 and pulley mounts 22 are shown in FIG. 1, it should be understood that the cord lock device 10 of the present invention has the capability to control a substantially greater number of cords 16. It should also be apparent that other forms of ladder devices may be utilized with the cords 16 to accomplish the same objectives.

Figure 2:
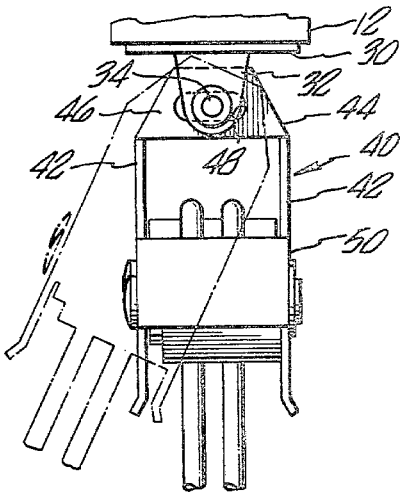
FIG. 2 is a side view of the cord lock device of the present invention illustrating the swivel capability.

Turning to FIG. 2, a side view of the cord lock device 10 is shown illustrating its attachment to the head bracket 12. Briefly, a top plate 30 is attached to the bracket 12 by conventional means which may be either screws, nuts and bolts or rivets, the plate 30 being integral with a pivot 32 having a rivet 34 associated therewith to suspend a housing 40. A pair of substantially parallel side walls 42 have bent top portions 44 at angles thereto, which are in turn connected to each other by a lip 46, the lip 46 having a slot 48 which is adapted to receive the rivet 34 thus permitting lateral movement of the housing 40. In the preferred embodiment it is also possible to rotate the housing 40 in a discreet angular displacement from the vertical by applying a lateral force thereto. In this manner, multiple freedoms of movement are achieved permitting various orientations of the cord lock device 10 when in use. The side walls 42 of the housing 40 are interconnected by a partial wall 50 formed from bending the side walls 42 one upon the other. The partial walls 50 are disposed with respect to the internal components of the cord lock device 10 such that the cords 16 extend over these walls 50 when affixed within the cord lock device 10 and cooperatively associated therewith.

Figure 3:
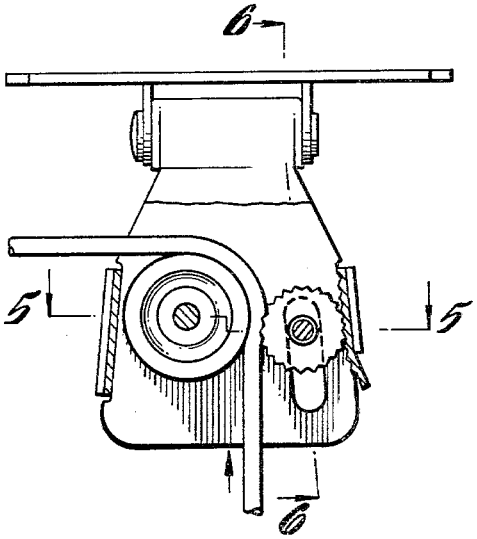
FIG. 3 is a transparent front view of the cord lock device with the cord in a locked position.
Figure 4:
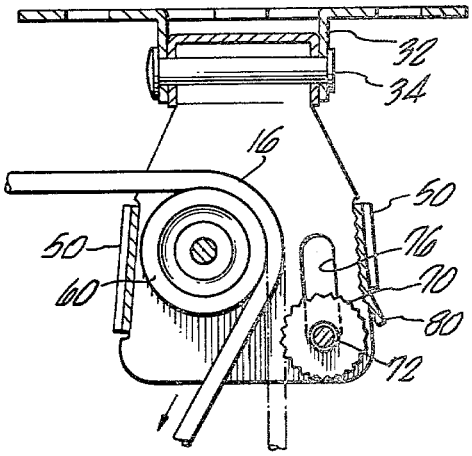
FIG. 4 is a transparent front view of the cord lock device with a cord in an unlocked position.
Figure 5:
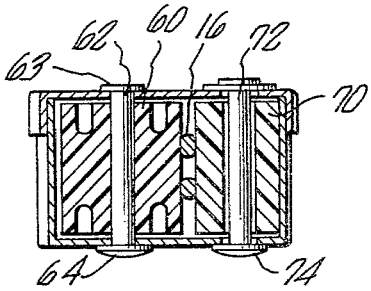
FIG. 5 is a top cross-sectional view of the cord lock device showing the position of the locking elements when the cord is locked therebetween.

In FIGS. 3 and 4, the cord lock device 10 is shown in its operative position, with the internal components in their respective orientations. A first roller 60 is rotatably mounted in and between the side walls 43 of the housing 40 by a pin 62, the first roller 60 having a circumference such that the pull cords 16 when trained thereover are able to operatively move above the partial wall 50. The first roller 60 may be made of either plastic or metal depending on the type and size of the pulley cords 16 to be used. Similarly, the first roller may have serrations thereon, however, the wear upon the cords 16 requires that in the preferred embodiment no serrations be present. As shown in FIGS. 3 and 5, by extending the pin 62 through the walls 42 and having hubs 63 juxtaposed thereto, a high degree of structural integrity is achieved in the housing 40.

Opposing the first roller 60 is a second roller 70 which may or may not have serrations thereon depending upon the type of cords 16 to be used and the desired responsiveness of the cord lock device 10, as well as, the weight of the blind 18 and slat 14 to be suspended thereby. A rivet or pin 72 extends throughout the second roller 70, the pin 72 having heads 74 larger than the diameter of the pin 72 and adapted to fit on the outsides of the sidewalls 42. Within the side walls 42 of the housing 40 a pair of opposing slots 76 are adapted to receive the pin 72, the heads 74 of the pin 72 being found on the exterior side of each of the slots 76. In this manner, the second roller 70 is permitted to traverse within the housing 40 then being guided by the slots 76. It should be noted that the slots 76 extend down and away from the first roller 60, thus carrying the second roller 70 into a second position with respect to the first roller 60 wherein a greater distance exists between their circumferences, thus permitting a cord 16 trained therebetween to move freely about the first roller 60 when the second roller 70 is in the second position. The width of the slots 76 may be much less than the diameter of the second roller 70, thereby substantially reducing the potential for cord abrasion and cord jamming, which may occur if the cords 16 became displaced within one of the slots 76.

The side wall 50 on the same side of the first roller 60 as the second roller 70 has associated therewith a serrated section 52 integrally connected therewith, the serrated section 52 being cooperatively engageable with the serrations located on the second roller 70, when present. At the lowermost portion of the sidewall 50 is a bent lip 80 which extends downward and outward from the plane of the side wall 50. It should be noted that the angle of the side wall 50 adjacent to the second roller 70 is substantially similar to the angle of the slots 76, whereas the lip 80 is bent at a more severe and extreme angle thereto. The position of the lip 80 with respect to the bottom area of the slots 76 is such that the second roller 70, when at its lowermost position within the slots 76, does not engage the serrations integral with the lip 80 or the side wall 50 superior thereto. The second roller 70 or pawl, is thus able to float free at this time, thus limiting the noise associated with other conventional cord lock devices, as well as, substantially reducing the cord abrasion found in other devices wherein the cord continuously engages the locking mechanisms. The pin 72 being slightly smaller than the internal diameter of the second roller 70, permits the roller 70 to move slightly closer to the serrations on the wall 50 and lip 80, when in an activated position. This second roller movement is designed to be variable and directly relative to the responsiveness of the cord lock device 10.

Figure 6:
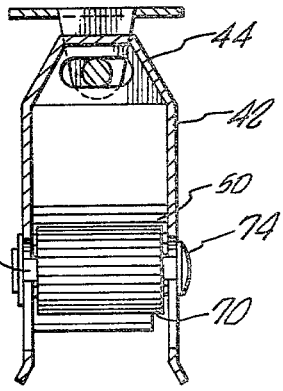
FIG. 6 is a side cross-sectional view of the cord lock device illustrating the respective positions of the locking members.

In FIGS. 5 and 6, the top and cross-sections of the cord lock device 10 illustrate further the disposition of the first and second rollers, 60 and 70, with respect to each other and the cords 16 when trained therebetween. As stated previously, although only two cords 16 are shown in the illustrations, it should be readily apparent that the number of cords 16 to be used may vary without departing from the capabilities of the cord lock device 10. The angle of the slots 76 and the relative diameters of the rollers 60 and 70 is also variable depending upon the width of the cords to be used and the operational characteristics desired.

Figure 7:
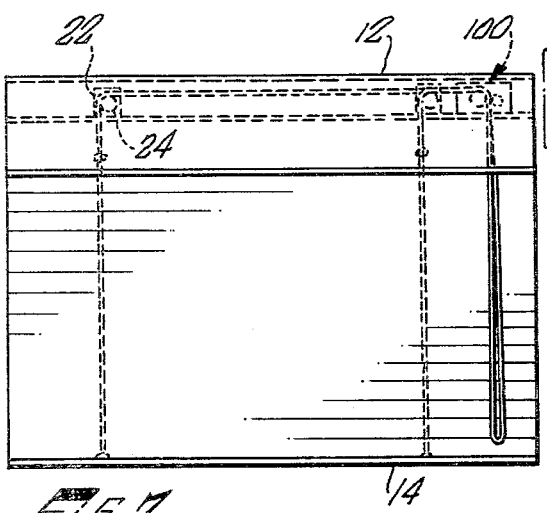
FIG. 7 is a front view of a second embodiment of the cord lock device of the present invention in an operative position.
Figure 8:
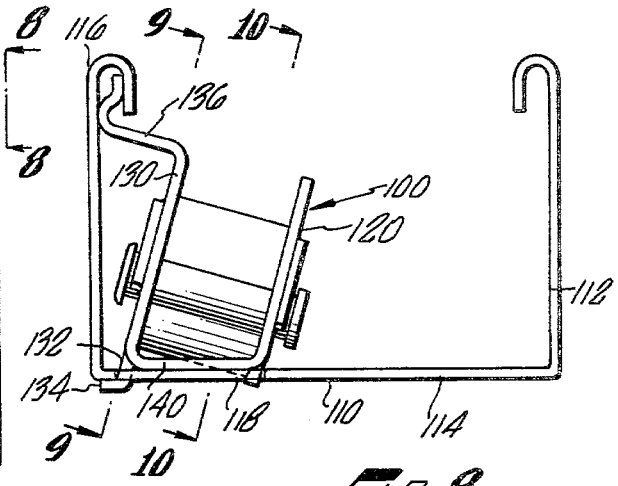
FIG. 8 is a side view of a second embodiment of the cord lock device showing the position of said device when in use.

A second embodiment of the cord lock device as shown in FIGS. 7 and 8, is designated generally as 100, and is shown operatively mounted below the head bracket 12. The same operative structures are present with respect to the slat 14 and cords 16, consequently, there is no need for further explanation in that respect. Of importance, however, in the second configuration, a channel-shaped bracket 110 has opposing sides 112 and a bottom plate 114, the opposing sides 112 having lips 116 bent in a U-shape and adapted to secure the cord lock device 100 within the interior of the channel-shaped bracket 100. As shown in FIG. 7, the cord lock device 100 is mounted at an angle with respect to the plane of the bottom wall 114, the angle being variable and designed to permit ease of operation, since the individual operating the cord lock device 100 will be standing at a position laterally displaced therefrom.

The cord lock device 100 has side walls 120 and 130 in substantially parallel alignment, each of which is at an angle to the bottom plate 110. A base wall 140 is integral with the side walls 120 and 130 and is proximately adjoined to the bottom plate 110 in a rigid manner. The side wall 130 has associated therewith a tab portion 132 which fits within an aperture 118 in the bottom plate 114, the tab portion 132 having a lip flange 134 which fits below the bottom plate 114. The side wall 120 has a similar tab portion 122 which also fits within the aperture 118 of the bottom plate 114 and cooperatively secures the cord lock device 100 into the bracket 110. The side wall 130 has an upper portion 136 adapted to fit under and in a clamping engagement with the U-shaped lip 116. By varying the length of the upper portion 136 and the angle of the bottom plate 140 with respect to the side walls 120 and 130, various angles of inclination may be achieved.

Figure 9:
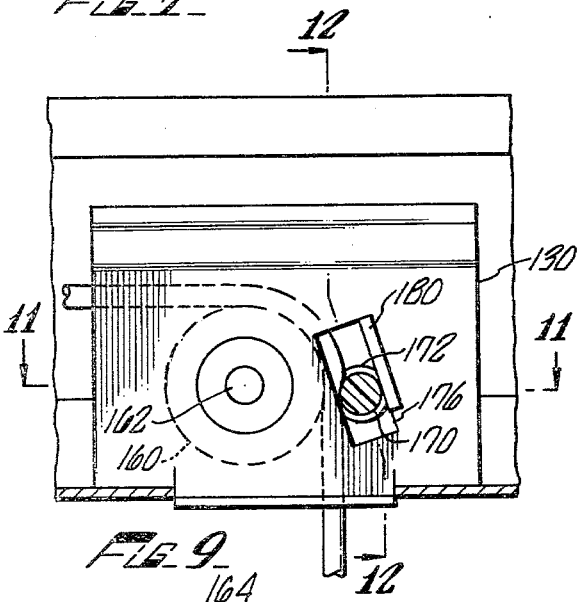
FIG. 9 is a front transparent view of a second embodiment of the cord lock device showing a cord in a locked position.
Figure 10:
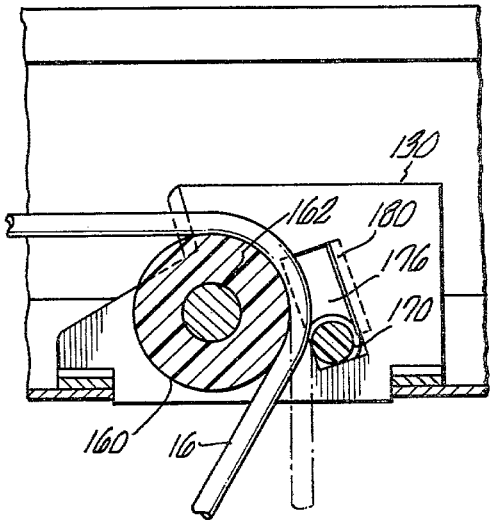
FIG. 10 is a front transparent view of a second embodiment of the cord lock device showing a cord in an unlocked position.

Referring to FIGS. 9 and 10, the second embodiment of the cord lock device 100 is shown in its operative position. Briefly, a first roller 160 is rotatably affixed between the side walls 120 and 130 by a pin or rivet 162, in this manner structural integrity is achieved without sacrificing the operative characteristics of the cord lock device 110. The hub members 164 integral with the rivet 162 and having a diameter larger than the rivet 162 are disposed on the exterior sides of the side walls 120 and 130 thus affixing the roller 160 therebetween. A pull cord 16 or series thereof are trained over the first roller 160 and are adapted to raise the blinds 18 or slat 14 of the present shade structure. The first roller 160 may be made of either plastic or metal depending upon the type and weight of the cord to be used and the operational characteristics desired of the cord lock device.

Figure 11:
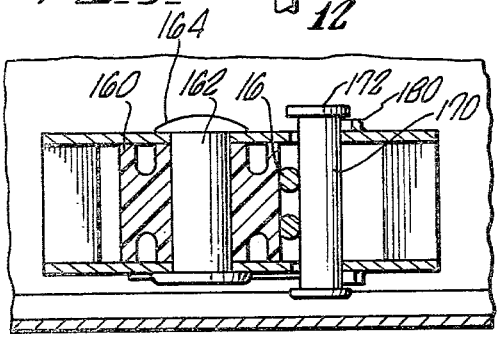
FIG. 11 is a top cross-sectional view of a second embodiment of the cord lock device illustrating the position of the locking members with cords locked therebetween.
Figure 13:
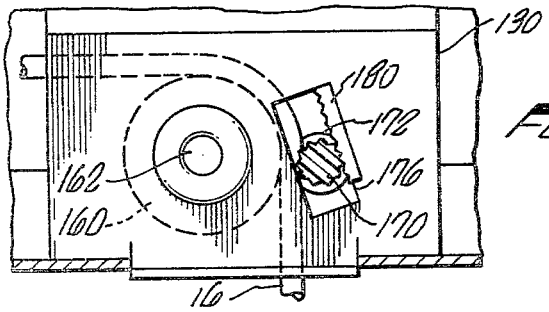
FIG. 13 is a side cross-sectional view of the second embodiment of the cord lock device illustrating serrated components.

Opposing the first roller 160 is a second roller 170, the second roller 170 having an enlarged head sections 172 on opposing ends. The enlarged head sections 172 are disposed on the exterior side of the side walls 120 and 130. Within the side walls 120 and 130 opposing slots 176 in substantially parallel alignment are disposed at an angle to the first roller 160, said slots 176 extending downward and outward from the first roller 160. The width of the slots 160 is such that the second roller 170 will fit therein with the head sections 172 thereof placed outside the side walls 120 and 130. As shown in FIGS. 9, 10, and 11, slugs 180 are secured to the side walls 120 and 130 in a customary manner and are engageable with the second roller 170. In this manner, greater responsiveness of the cord lock device 100 is achieved. As shown in FIG. 13, it should be apparent that the second roller 170 may operate with serrations thereon in a somewhat similar manner. In this embodiment the slugs 180 would have engageable serrations. As in the first embodiment, when the second roller 170 is at its lowermost position in the slots 176, as illustrated in FIG. 10, the cords 16 are permitted to move freely about the first roller 160 without wear or abrasion acting upon them.

Figure 12:
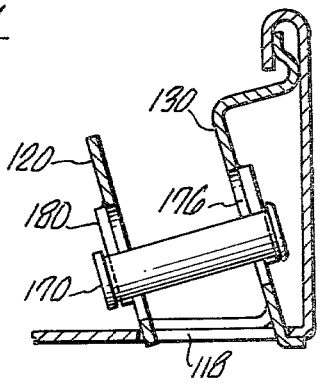
FIG. 12 is a side cross-sectional view of a second embodiment of the cord lock device illustrating the relative position of the locking members.

In FIGS. 11 and 12, the top and side cross-sectional views of the cord lock device 100 are shown illustrating the relative disposition of the first roller 160 with respect to the second roller 170. Also shown is the engagement of the second roller 170 with the slugs 180, the cords 16 locked between the first roller 160 and the second roller 170 at the uppermost portion of the second roller 170.

In operation, the cord lock device 10 of the first embodiment swivels to the appropriate angle for movement of the cords 16. The cords 16 are then pulled such that the angle between the vertically extending portion of the cord 16 and the horizontally extending portion of the cord 16 is decreased, by this procedure the second roller 70 falls to the bottom of the slots 76 thus permitting free movement of the cords 16 over the first roller 60. At this point, the second roller 70 does not engage the lip 80 or the wall section 50 or the serrations thereon. When the cords 16 are permitted to fall freely, to their naturally vertical position, the second roller 70 is engaged and is caused to traverse up the lip 80 and wall section 50, until a position is reached when the distance between the first and second rollers, 60 and 70 is less than the diameter of the cord 16. Although some diametrical distortion may appear in the cords 16, a position will be reached wherein the cords 16 are locked between the rollers 60 and 70. The automatic nature of this action, dramatically reduces the possibility of shade crash and increases the overall responsiveness of the device.

In operation, the second embodiment of the cord lock device is substantially similar to the first embodiment. Briefly, as shown in FIG. 10, the cords 16 are pulled in an angular downward direction, the angle being decreased between the horizontal and vertical sections thereof. This action causes the second roller 170 to fall to the bottom of the slots 176, where it is free to rotate. At this point the cords 16 are free to move in an upward and downward direction about the first roller 160, thus permitting the shade 18 and slat 14 to move in either an upward or downward position. When the cords 16 are released, they fall to a vertical disposition, at which time they engage a second roller 170 causing it to traverse up the slug 180. At a certain position, depending upon the designed distance between the first and second roller 160 and 170, the diameter of the cords 16 will be greater than the decreasing distance. As in the first embodiment, despite some cord distortion, locking will occur, thus restricting the downward movement of the slat 14 and blind 18 members. In this embodiment, multiple cords may be used therewith depended upon the spacial relationship between the first and second rollers, 160 and 170 and the width of the bracket 110.

By the above, it should be readily apparent that the cord lock devices 10 and 100 of the present invention provide automatic locking operation, substantially reduced cord wear, thereby increasing cord life, provide for the use of multiple cords, and illustrate a high responsiveness. It should also be noted that these devices may be made of either metal or plastic depending upon the weight of the shade device to be suspended. Furthermore, minimum friction acts upon the cord when the blind is raised or lowered.

Although the present invention has been described in great detail, it is understood that certain changes and modifications may be made within the spirit of our invention.

We claim:

1. A cord lock device having a housing, a first cylindrical roller and a pull cord trained about said roller with a substantially vertically hanging portion, comprising:

the housing including walls defining a pair of parallel facing elongated slots, said slot extending along a substantially straight-line path from an upper limit downwardly and outwardly of the vertically hanging cord to a lower limit;

a second roller having its end portions received within the respective housing slots, said end portions being of such dimensions as to permit rotating and sliding along the slots, and the central portion of the second roller being larger in cross-section than said end portions and having its peripheral surface formed to include a plurality of longitudinally extending raised ridges and when said second roller is located at the lowermost limit of the housing slots the raised ridges of said second roller contact the substantially vertically hanging portion of the pull cord; and a wall mounted to the housing having a first surface facing the cord and extending substantially parallel to the slots straight-line path to a point spaced upwardly from the lowermost slot ends and a second surface integral with said first surface directed at an angle outwardly away from the first surface, said first and second surfaces including a set of teeth dimensioned to engage the raised ridges on the second roller whereby the second roller raised ridges securingly engages the cord and has the roller raised ridges received within the wall teeth throughout all positions of said second roller along the first wall surface, and on moving of the second roller downwardly to engage the teeth of the wall second surface the degree of engagement decreases until total disengagement occurs on the second roller being located at the lowermost positions of the slots.

* * * * *